US005862557A

United States Patent [19]

Aubert

[11] Patent Number: 5,862,557

[45] Date of Patent: Jan. 26, 1999

[54] BRIDGING SPAN STRUCTURE

[75] Inventor: Henri Aubert, Sanary, France

[73] Assignee: Constructions Industrielles de la Mediterranee-CNIM, Paris, France

[21] Appl. No.: 817,408

[22] PCT Filed: Jul. 31, 1996

[86] PCT No.: PCT/FR96/01213

§ 371 Date: Mar. 26, 1997

§ 102(e) Date: Mar. 26, 1997

[87] PCT Pub. No.: WO97/05333

PCT Pub. Date: Feb. 13, 1997

[30] Foreign Application Priority Data

Aug. 2, 1995 [FR] France ..... 95 09433

[51] Int. Cl.[6] ..... E01D 15/12; E01D 15/10

[52] U.S. Cl. ..... 14/2.4; 14/2.5; 14/2.6

[58] Field of Search ..... 14/2.4, 2.5, 2.6

[56] References Cited

U.S. PATENT DOCUMENTS 5,363,527 11/1994 Rainaud et al. ..... 14/2.4

FOREIGN PATENT DOCUMENTS 0563872 10/1993 European Pat. Off. .
2683837 5/1993 France .

*Primary Examiner*—Tamara L. Graysay
*Assistant Examiner*—Sunil Singh
*Attorney, Agent, or Firm*—Leydig, Voit & Mayer

[57] ABSTRACT

A bridging span structure intended in particular for the crossing of ditches by vehicles and a system for transporting and depositing such a structure, wherein each connecting arm is rotatably mounted in relation to a bridging span about a pivoted bolt and wherein an arrangement is provided for urging the connecting arm automatically back to its normal position of use and for holding this connecting arm in this normal position, the invention being applicable to military armoured vehicle of the Engineering Corps.

16 Claims, 11 Drawing Sheets

BRIDGING SPAN STRUCTURE

BACKGROUND OF THE INVENTION

The present invention relates to a bridging span structure intended in particular for the clearing of ditches by vehicles such as armoured vehicles of the Engineering Corps and a system for the transport on a vehicle of at least two bridging span structures intended for the clearing of ditches and for laying down the bridging span structures over the ditches from the vehicle.

A system has been proposed for laying down from a vehicle a bridging span of short length or of greater length after the end-to-end assembly of two or more bridging spans of short length.

Such a system is described in the document FR-B-2,683,837 in the name of the applicant and essentially comprises a beam for supporting and launching a bridging span or assembled bridging spans, displaceable in relation to the vehicle towards an overhanging position; means for the displacement of the bridging span or of the assembled bridging spans in relation to the beam to an overhanging position forward of the beam; and a plate supporting in a guided manner the beam and which may tilt in relation to the vehicle together with the beam to permit the laying down of the bridging span or of the assembled bridging spans over a ditch to be cleared.

In the inactive position or position of transport on the load vehicle, the beam has its portion behind the supporting plate accommodated between two superposed bridging spans and the connecting arms forming braces of both bridging spans, each one being U-shaped and pivotally connected at its ends to two internal side-walls, respectively, of two central boxes of two bridging span elements. Both connecting arms of the lower bridging span assume a downward swung or lowered position permitting to increase the space for the accommodation of the beam and these connecting arms may be simultaneously swung upwards by a lifting table to a position substantially parallel to the frame of the vehicle, in which they are locked to the lower bridging span.

The hereabove known system has thus the major inconvenience to require a complex structure of lifting table mounted onto the chassis of the vehicle and associated control means for raising it from an inoperative position, after withdrawal of the beam from above the lower bridging span and acting upon the lower ends of the U-shaped connecting arms of this bridging span to move them away from each other to their position of locking to the lower bridging span.

SUMMARY OF THE INVENTION

The present invention has as its object to remove the hereabove inconvenience of the known system by proposing a bridging span structure intended in particular for the clearing of ditches by vehicles such as armoured vehicles of the Engineering Corps, comprising two parallel bridging span elements with upper treadways and connected to each other by two connecting arms forming braces and which is characterized in that each connecting arm has approximately a Ω-shape, both coaxial base elements of which comprise bolts having each one of their ends connected to the body of the corresponding bridging span element by a ball-and-socket pivotal connection; each pivoted bolt is rotatably mounted oppositely from its ball-and-socket pivotal connection in a bearing held against rotation at the body of the bridging span element and which may slide in relation to the latter so as to permit the displacement of the pivoted bolt in a plane perpendicular to the bridging span elements about the centre of pivotal connection of this bolt; and in that means are provided for automatically returning each connecting arm to its normal position of use in a plane substantially perpendicular to both bridging span elements and to hold the connecting arm in this normal position of use.

Preferably the returning and holding means of each connecting arm comprise two identical parallel cams made fast to the connecting arm at both ends of the pivotally connected bolts opposite to the ball-and-socket pivotal connections and the axes of rotation of which are coaxial with the axes of rotation of the pivotally connected bolts; and two rollers held in bearing relationship by an elastic means upon the lower portion of the eccentric shape of each cam according to a force providing the holding of the connecting arm in its normal position of use, the eccentric shape of the cam being such that during the rotation of the connecting arm in one direction or in the other one, either one of the two rollers exerts upon this cam a torque for the rightening of the connecting arm to its normal position.

Both rollers are mounted onto a common yoke made fast to one end of a supporting shaft slidably mounted in a stationary casing made fast to the body of the corresponding bridging span element and the aforesaid elastic means comprises a prestressed spring accommodated in the stationary casing and exerting upon the supporting shaft a force for holding both rollers or either one thereof in bearing relationship upon the lower periphery of the corresponding cam.

Advantageously the lower portion of each cam where both corresponding rollers are simultaneously bearing is flat and is located between two symmetrical portions of the eccentric shape of the cam.

Preferably, the bearing is a parallelepipedic block accommodated in a rectangular guiding window of the block formed in the body of the corresponding bridging span element in perpendicular relation to the longitudinal axis of the latter.

Each ball-and-socket pivotal connection comprises a bracket for supporting the female sphere in which is accommodated the male sphere made fast to the end of the corresponding pivotally connected bolt, the supporting bracket being itself fastened in a supporting part made fast for example by welding to the body of the corresponding bridging span element.

The bridging span structure also comprises in association with each one of the two connecting arms, at least two stops made fast to both bridging span elements, respectively, onto which the corresponding connecting arm may be caused to bear in the swung down position of the latter.

Each connecting arm comprises two pairs of riding rollers each extending parallel to the bridging span elements and made fast to the central connecting portion of the Ω.

Protective rubber bellows are provided for tightly closing the passageways between the bearings and the rectangular guide windows.

In the normal position of use of one connecting arm, the prestressed springs associated therewith have their maximum length.

The invention also proposes a system for the transfer upon a road vehicle such as a truck of at least two bridging spans superposed on a frame of the vehicle and which may be assembled end-to-end and for laying down each one of the bridging spans or of end-to-end assembled bridging spans over a ditch to be cleared, each bridging span having such a structure as previously defined and being of the type comprising a beam for supporting and launching one bridging span or assembled bridging spans and displaceable in relation to the vehicle towards an overhanging position; means for the displacement of the bridging span or of the assembled bridging spans in relation to the beam to an overhanging position forward of the supporting and launching beam; and a plate supporting in a guided manner the beam and which may tilt in relation to the vehicle together with the beam to permit the laying down of the bridging span or of the assembled bridging spans. During the laying down of the bridging span or of the assembled bridging spans, that end of this bridging span or of these assembled bridging spans which is opposite to that already bearing upon the bank of the ditch opposite to the road vehicle is supported at the end of the laying-down and launching beam by the rear connecting arm of both bridging spans elements of the bridging span or of the rear bridging span of the assembled bridging spans during the tilting of the beam until the laying down of the said end of bridging span or of the assembled bridging spans upon the bank adjacent to the road vehicle, whereas the connecting arm bearing upon the laying-down beam may pivot in relation to the bridging span elements above the pivotally connected bolts so that the connecting arm may adapt itself to the different inclinations of the laying-down beam.

In the transportation position on the road vehicle, the laying-down and launching beam is disposed between two superposed bridging spans and the connecting arms of both bridging span elements of the lower bridging span assume a downwards swung position underneath the laying-down and launching beam while being in contact with the latter through the medium of the riding rollers of the connecting arms.

Both downwards swung connecting arms are also bearing upon the stops made fast to the bridging span elements.

The connecting arms are rightened to their normal position by the returning means exerting a rightening torque thereupon after withdrawal of the laying-down and launching beam from between both superposed bridging spans.

The means for the displacement of the bridging span or of the assembled bridging spans in relation to the laying down and launching beam comprise an endless drive chain extending along the longitudinal axis of the beam and mounted onto at least two toothed end wheels themselves rotatably mounted onto the beam; and at least two elements forming a fork and made fast to the drive chain and adapted to grip the central portion of one connecting arm between both pairs of riding rollers of this arm bearing upon the laying-down and launching beam.

BRIEF DESCRIPTION OF THE DRAWINGS

The invention will be better understood and further objects, characteristics, details and advantages thereof will appear more clearly in the explanatory description which will follow with reference to the attached diagrammatic drawings given by way of example only illustrating one embodiment of the invention and in which.

DESCRIPTION OF PREFERRED EMBODIMENTS

Figure 1:
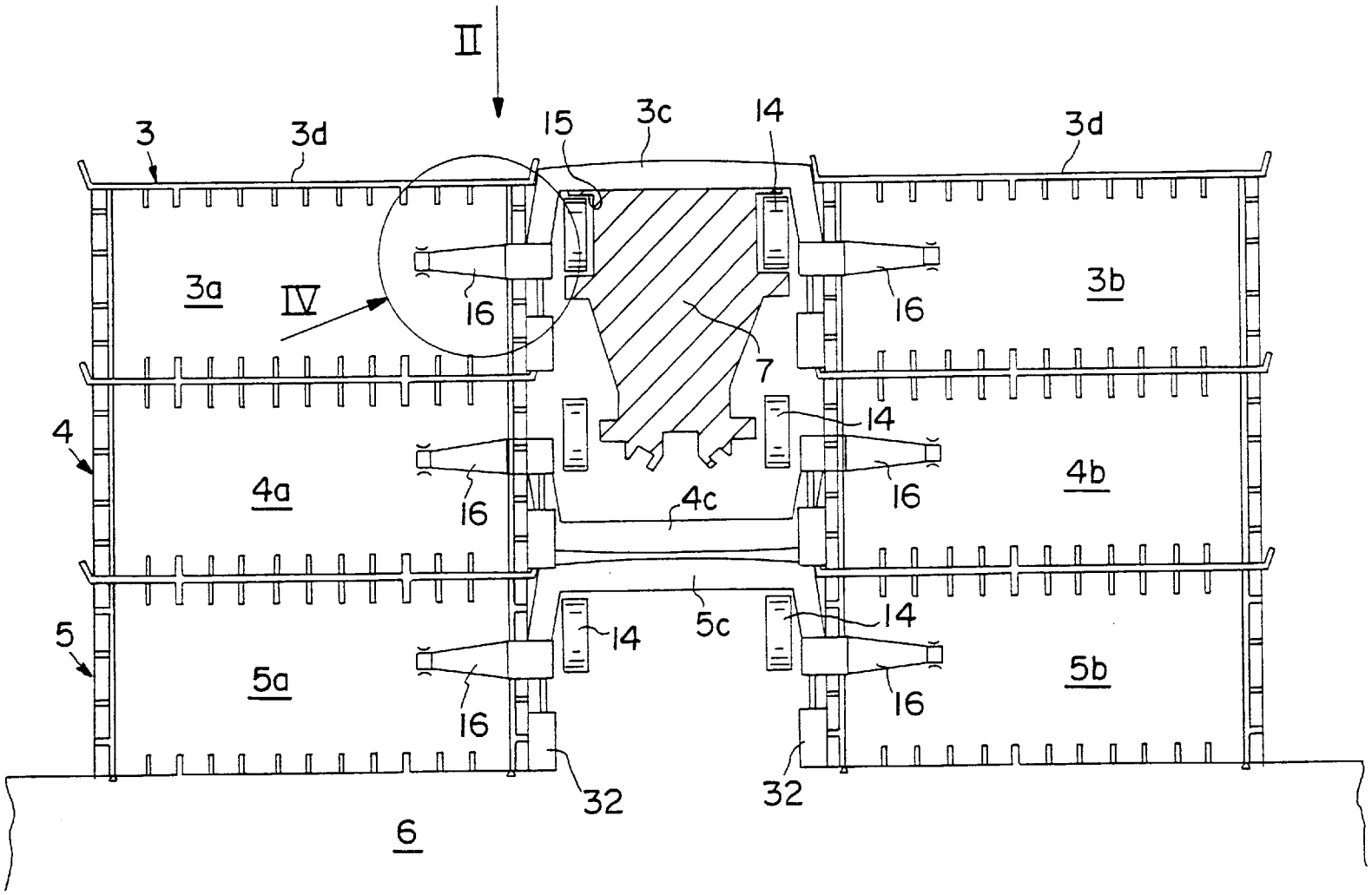
FIG. 1 is a view in cross section showing three superposed bridging spans in the transportation position upon a road vehicle.
Figure 2:
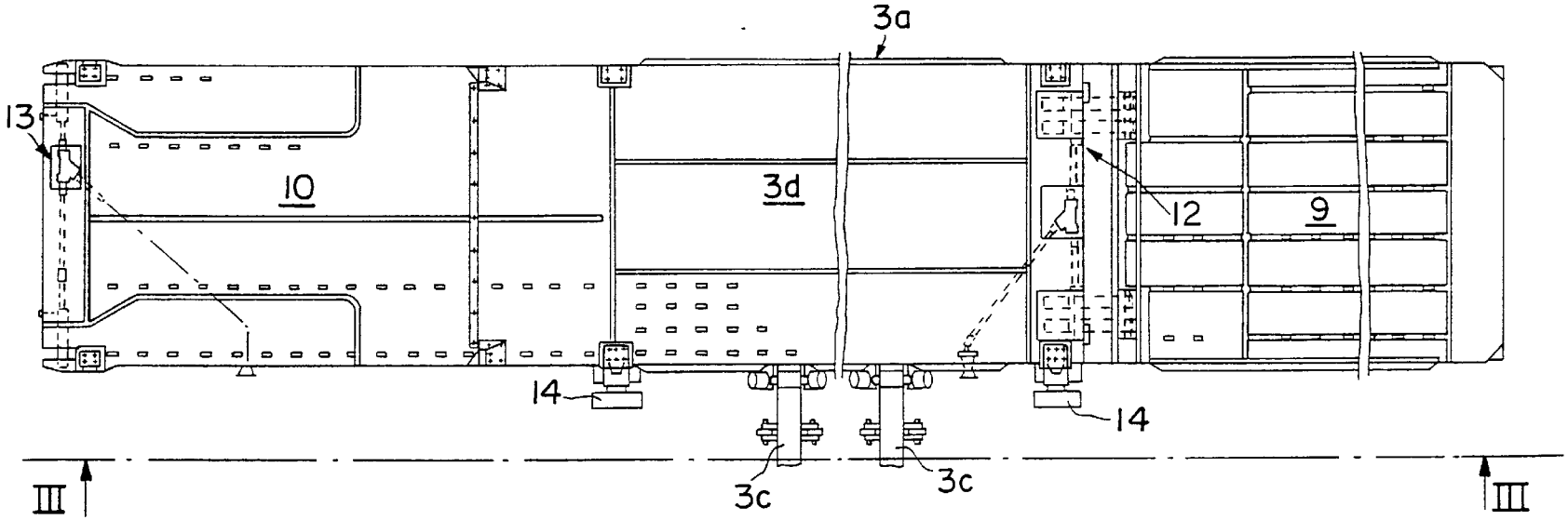
FIG. 2 is one-half of a top view in the direction of the arrow II of FIG. 1.

Referring to the figures, reference numeral 1 designates a road vehicle such as a truck permitting to transport towards a ditch 2 to be crossed by vehicles, such as armoured vehicles of the Engineering Corps, three bridging spans, namely an upper bridging span 3, an intermediate bridging span 4 and a lower bridging span 5, superposed on a longitudinal chassis 6 of the vehicle.

The vehicle 1 supports a system adapted for separately depositing the bridging spans 3, 4, 5 over ditches or for assembling at least two bridging spans end-to-end and depositing the assembled bridging spans above a ditch.

The system for assembling bridging spans and for depositing the latter is in a general manner identical with the one described in French patent No 2,683,837 incorporated herein by way of reference and will therefore not be discussed in detail, apart from the few differences which will appear subsequently in the present description.

Figure 11:
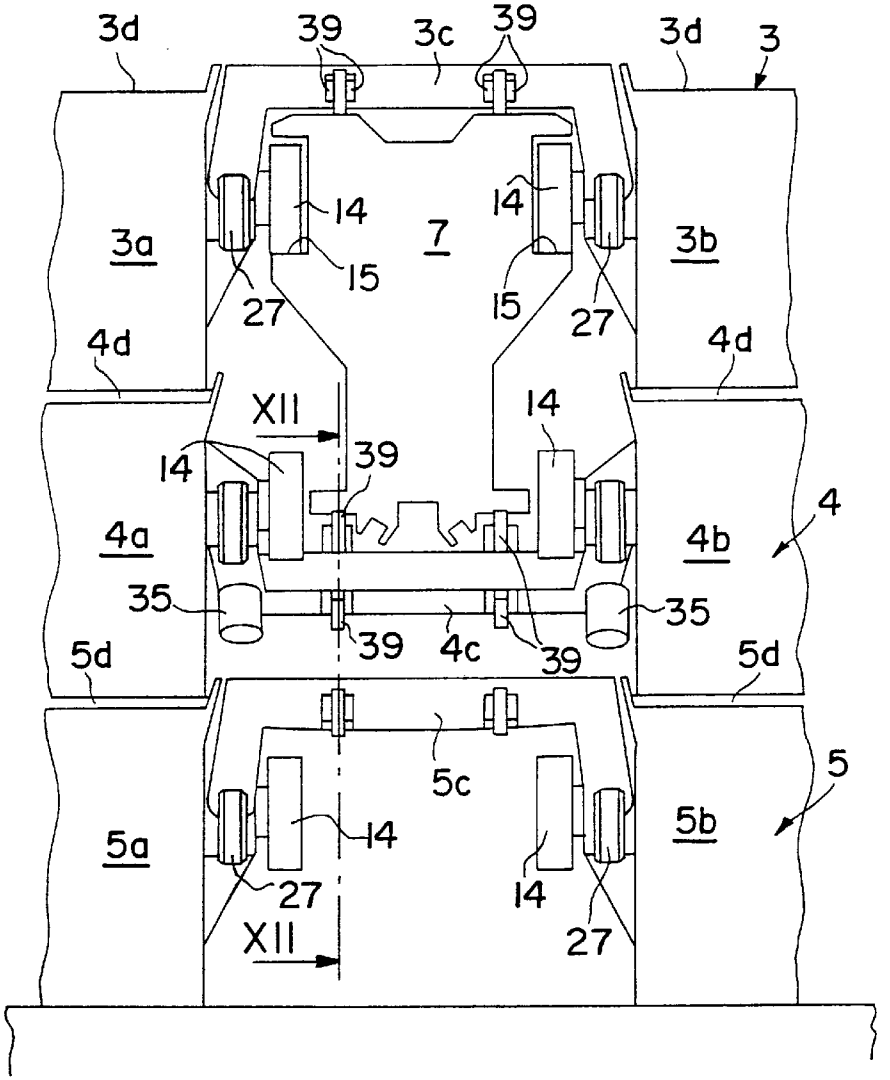
FIG. 11 is an enlarged view in cross section of the central portion of FIG. 1.

The bridging spans 3, 4, 5 are identical and are each formed of two parallel bridging span elements 3*a*, 3*b*; 4*a*, 4*b*; 5*a*, 5*b* connected to each other by two connecting arms forming braces 3*c*, 4*c* and 5*c*. Each connecting arm may be swung downwards from its normal position of use to a position permitting the passage of a beam 7 for launching and depositing a bridging span as shown in FIGS. 1 and 11. These figures thus show that the connecting arm 4*c* of the intermediate bridging span 4 assumes a downwards swung or lowered position so as to increase with respect to the connecting arm 3*c* of the upper bridging span 3 the height of accommodation of the beam 7 in the resting or inactive position upon the vehicle 1.

Figure 3:
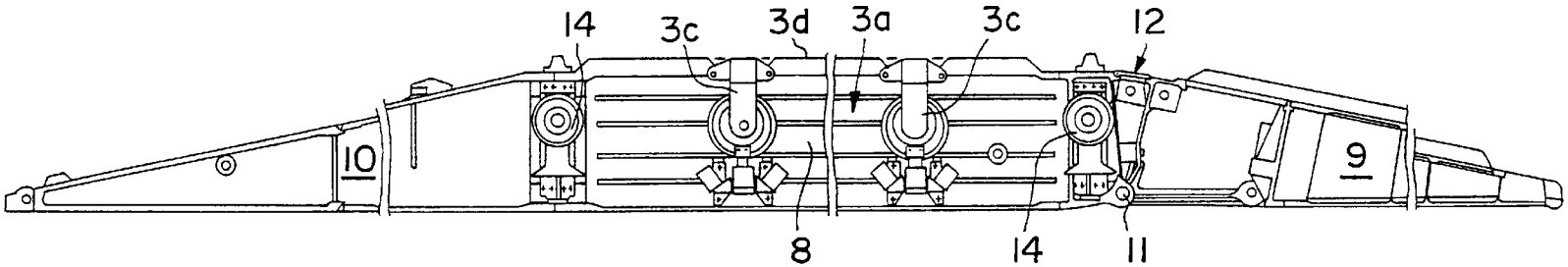
FIG. 3 is a view in section taken along line III—III of FIG. 2.

Both bridging span elements of each bridging span 3, 4, 5 comprise two parallel upper trackways 3*d*, 4*d* and 5*d* and each bridging span element comprises a central rigid body or box 8 and two access jibs 9, 10 assembled to both ends, respectively, of the central box 8 so as to extend the upper trackway of this box. The access jib 9 is fastened to one portion of the central box 8 by a transverse pivot pin 11 and to an opposite portion of this box by locking means 12 which are unlockable so as to permit the jib 9 to assume a lower position shown on FIG. 3 in the case where one bridging span 3; 4; 5 only should be deposited over a ditch, or an upward swung position as this appears from the assembled bridging spans 3, 4, 5 in FIGS. 17A–F and in which the upper swung jib 9 of the bridging span is fastened by suitable locking means upon another stationary jib 10 of an adjacent bridging span to form a bridging span of greater length.

The means for locking each liftable jib 9 of one bridging span to the corresponding box 8 of the latter and the means for locking each raised access jib 9 to a stationary jib of another adjacent bridging span may be of the kind described in French patent No 2,683,837. These locking means may also be constituted by those which have been described in French patent application No. 95 09 432 filed on Aug. 2, 1995 in the name of the applicant and incorporated herein by way of reference.

Both elements of one bridging span 3; 4; 5 are assembled by their connecting arms in such a manner that the bridging span may have available at each one of its ends, two access jibs, namely a movable access jib 9 and a stationary access jib 10, respectively, so that there be no imposition for the direction of presentation of the bridging spans during their coupling.

Each bridging span 3; 4; 5 moreover comprises two pairs of front and rear riding rollers 14 fastened in mutually confronting relationship to both internal side walls located opposite each other, respectively, of two bridging span elements. The riding rollers 14 permit the displacement of the corresponding bridging span along the depositing and launching beam 7 by riding upon two guide rails 15 formed of two side shoulders, respectively, of the beam 7 provided at its upper portion.

Figure 4:
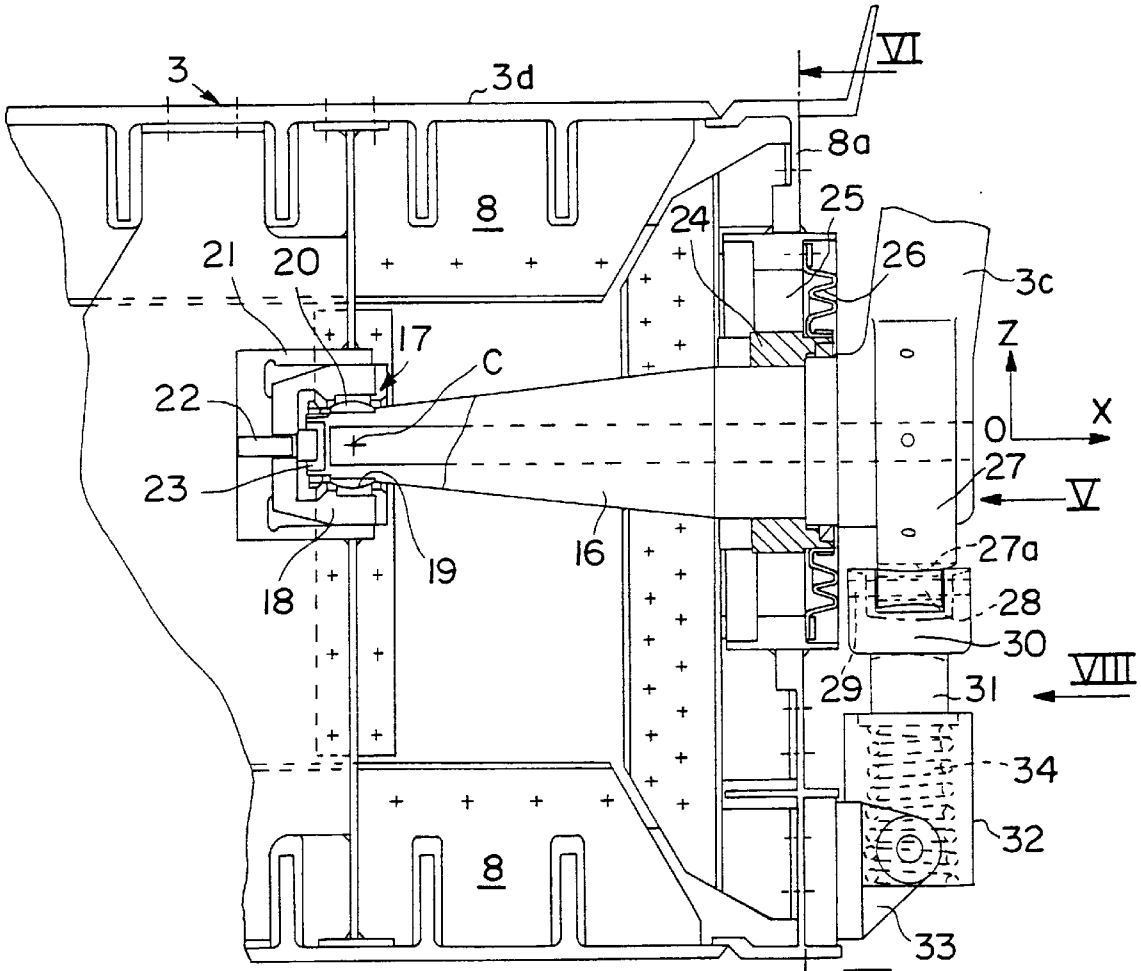
FIG. 4 is an enlarged view in section of the portion circled at IV in FIG. 1.
Figure 6:
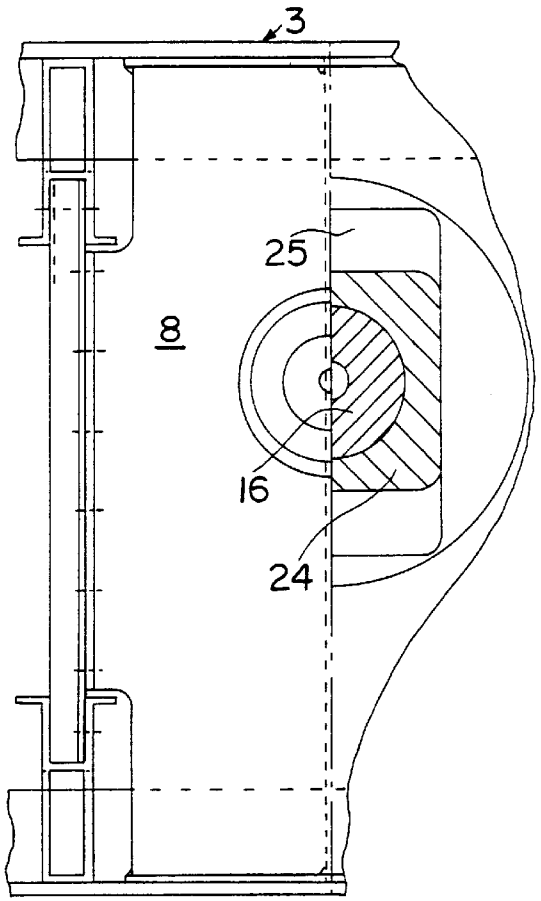
FIG. 6 is a view in half-section taken along line VI—VI of FIG. 4.

According to the invention, each connecting arm has approximately an Ω-shape located in the normal position of use shown in FIGS. 1 and 11 for the upper and lower bridging spans 3 and 5, in a plane substantially perpendicular to the longitudinal axes of both corresponding bridging span elements. Both coaxial elements of the base of the Ω are constituted by bolts 16 directed transversely of both corresponding bridging span elements in the normal position of use of the associated connecting arm and which are each one connected to the body of the box 8 of one bridging span element, in the present case the element 3*a* of the bridging span 3 as shown in FIG. 4, by a ball-and-socket pivotal connection 17 comprising a bracket 18 for supporting the female sphere 19 in which is accommodated the male sphere 20 made fast to the end of the pivoted bolt 16, the supporting bracket 18 being itself fastened in a female supporting part 21 made fast for example by welding to the body 8 of the bridging span element 3*a*. The bracket 18 is fastened in the supporting part 21 by a screw 22 coaxial with the pivoted bolt 16 and the head of which is accommodated in a bore 23 endwise of the bolt 16.

Each pivoted bolt 16 of one connecting arm is rotatably mounted oppositely from its ball-and-socket pivotal connection 17 in a bearing or pad 24 constituted by a generally parallelepipedic block held against rotation in relation to the body 8 of the bridging span element in a rectangular window 25 formed in the body 8 in perpendicular relation to the longitudinal axis of the bridging span element and in which the bearing 24 may slide. Each window 25 is provided in the longitudinal web 8*a* of the body 8 of the bridging span element so that the bearings 24 convey the longitudinal forces exerted upon the bolts 16 into the longitudinal webs 8*a* of the body 8. The ball-and-socket pivotal connection 17 and the bearing 24 of each pivoted bolt 16 thus permit a free rotation about its axis of rotation OX and a vertical displacement thereof along an orthogonal axis OZ as symbolized in FIG. 4, of the corresponding connecting arm 3*c*, 4*c* and 5*c*. Otherwise said, each bolt 16 may turn about the axis OX and may move about the centre of pivotal connection C of the ball-and-socket pivotal connection 17 in a plane perpendicular to the corresponding bridging span element as one will see subsequently in some of the cases of use of the bridging spans.

A rubber bellows 26 is tightly fastened about the external end of the bearing 24 and to the longitudinal web 8*a* of the body 8 in a suitable housing of the latter so as to protect the inside of the body 8 of the beam from dirt such as mud.

Each bridging span element also comprises means permitting the automatic return of each connecting arm of two bridging span elements to its normal position of use and to hold the arm in this position.

Figure 5:
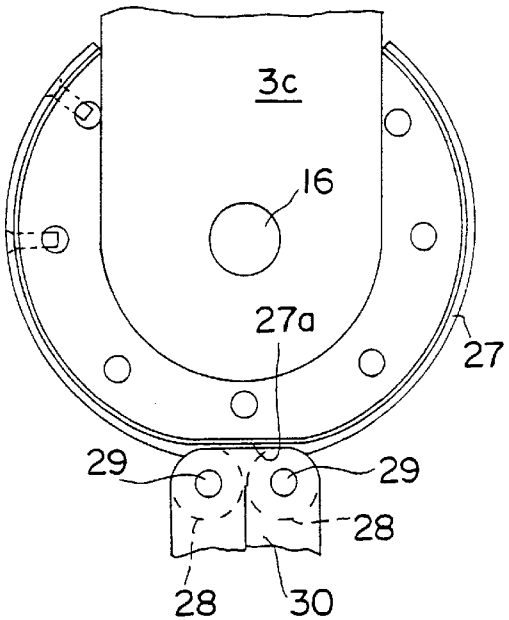
FIG. 5 is a side view in the direction of arrow V of FIG. 4.

These means comprise two identical parallel cams 27 made fast to the corresponding connecting arm 3*c*, 4*c*, 5*c* at both ends of the pivoted bolts 16 opposite from the ball-and-socket pivotal connections 17. The axis of rotation of each cam 27 is coaxial with the axis of rotation of the bolt 16 and the eccentrically shaped formation of the cam 27 extends about the bolt 16 over an angle of about 270° as best shown in FIG. 5 while being symmetrical with respect to the middle plan extending transversely of the corresponding bridging span element and passing through the pivoted bolt 16.

The means for returning and holding each connecting arm also comprise two rollers 28 with axes of rotation 29 parallel to the axis of rotation of the corresponding pivoted bolt 16 and elastically held in bearing relationship upon the lower portion 27*a* of the eccentrically shaped formation of the cam 27 with a force providing for the stable holding of the corresponding connecting arm 3*c*, 4*c*, 5*c* in its normal position. The eccentrically shaped formations of both cams 27, respectively, associated with one connecting arm are such that during a rotation of this arm in one direction or in the other one about the axis OX, either one of the two rollers 28 exerts upon each corresponding cam 27 a torque for rightening the corresponding connecting arm to its normal position as will be seen subsequently.

Both rollers 28 are mounted in a common yoke 30 made fast to one end of a supporting shaft 31 slidably mounted in a stationary casing 32 made fast to the web 8*a* of the body 8 of the corresponding bridging span element by a fastening flange 33. As shown in FIG. 4, the shaft 31 is perpendicular to the axis of rotation OX of the corresponding pivoted bolt 16 and a prestressed spring 34, constituting the elastic means holding both rollers 28 in bearing relationship upon the cam 27, is accommodated in the stationary casing 32 substantially coaxially with the supporting shaft 31 which is shown in the upper high position corresponding to the maximum elongation of the spring 34. As shown in particular in FIG. 5, the lower portion 27*a* of each cam 27 whereupon both corresponding rollers 28 are simultaneously bearing in the normal position of the connecting arm is flat and located between both symmetrical portions of the eccentrically shaped formation of the cam 27.

Figure 9:
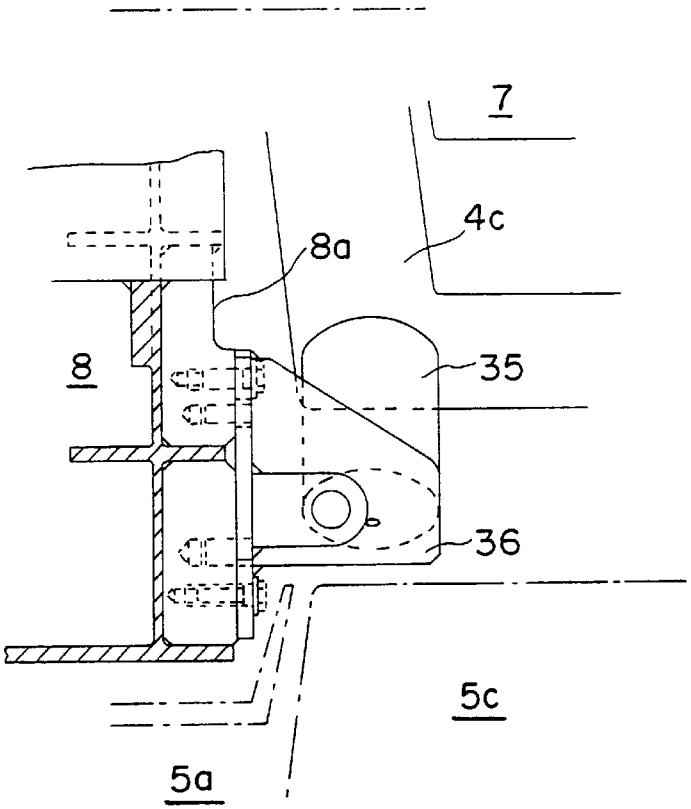
FIG. 9 is a view in section taken along line IX—IX of FIG. 8.
Figure 8:
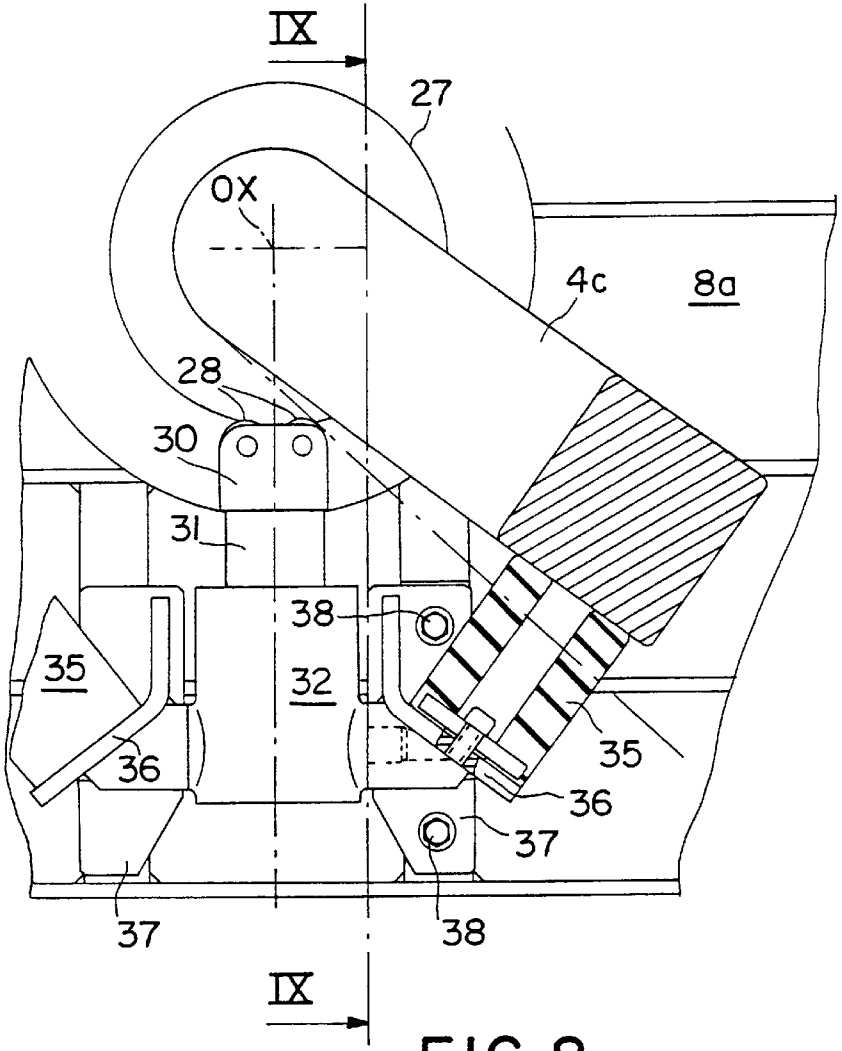
FIG. 8 is a view in the direction of arrow VIII of FIG. 4 with one connecting arm of two bridging span elements in the downward swung position.

FIGS. 8, 9 and 11 show that at least one of the bridging spans 3, 4, 5, in the present case the intermediate bridging span 4 also comprises two pairs of cylindrical rubber stops 35 fastened to both mutually confronting webs 8*a*, respectively, of both elements 4*a* and 4*b* of the bridging span 4 with both stops 35 of each pair being located symmetrically to the plane orthogonal to the longitudinal axis of the corresponding bridging span element and passing through the axis of rotation OX of the connecting arm 4*c*. Each stop 35 is fastened to a fastening lug 36 fastened in perpendicular relation to a plate 37 made fast to the web 8*a* by fastening screws 38. The cylindrical stops 35 of a same pair are fastened with their respective lugs 36 so that their longitudinal axes be inclined in relation to the plane of symmetry. Moreover both stops 35 facing each other of two bridging span elements, respectively, are positioned in relation to these bridging span elements so that the corresponding connecting arm be caused in its downward swung lower position to bear upon these two stops 35 while being inclined with respect to the plane of symmetry by a predetermined angle value for example of about 55° as shown in FIG. 8. The putting in abutment of the connecting arms 4*c* of the intermediate bridging span has the advantage of vertically locking (or jamming) this same bridging span underneath the launching beam and on the same occasion the lower bridging span (held in the ascending vertical direction).

Figure 12:
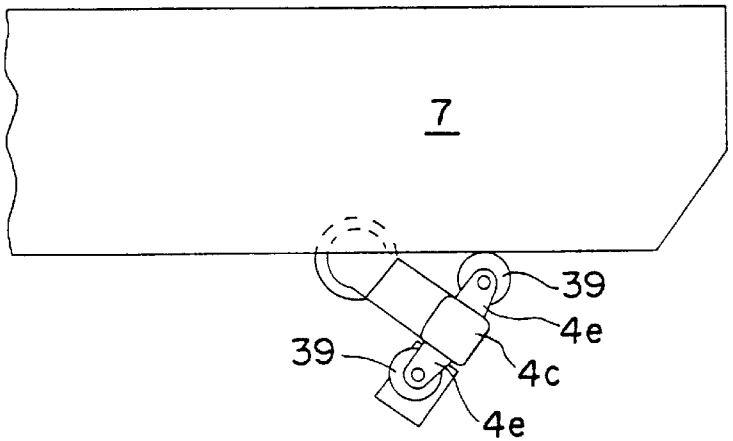
FIG. 12 is a view in section taken along line XII—XII of FIG. 11.
Figure 10:
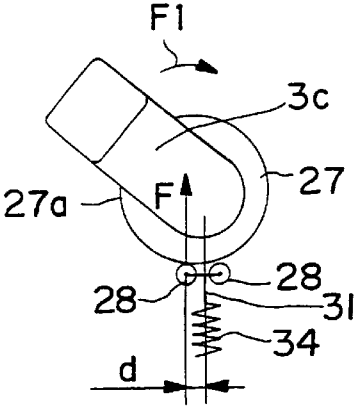
FIG. 10 is a diagrammatic side view of the means for righting one connecting arm of bridging span elements to its normal position.

Each connecting arm 3*c*, 4*c*, 5*c* comprises a central portion of the upper leg of the Ω-shaped formation of this arm, two pairs of riding rollers 39 permitting friction between the central portion of the connecting arm and the upper portion of the depositing and launching beam 7 to be avoided during a relative displacement of this beam and of the connecting arm. Both rollers 39 of one pair are fastened onto yokes 4*e* made fast to the corresponding connecting arm while extending in perpendicular relation to the central portion of this arm. As shown in FIG. 12, both connecting arms 4*c* of the intermediate bridging span 4 are held by the rollers 39 in bearing relationship upon the corresponding lower portions of the beam 7 by the rightening torque of each arm exerted by one of the rollers 28 upon each corresponding cam 27. When the beam 7 is disengaged from its storage position between both upper and intermediate bridging spans 3 and 4 during the procedure of launching and depositing of one bridging span or of assembled bridging spans above a ditch, the connecting arms 4*c* of the intermediate bridging span 4 automatically assume again their normal vertical position. FIG. 10 shows the upwards swinging phase of one connecting arm in the direction of rotation shown by the arrow F1 after the withdrawal of the beam 7. On this figure, one of the rollers 28 is bearing due to the prestressed spring 34 upon the corresponding cam 37 at a distance d from the plane of symmetry previously defined so that the roller 28 exerts a rightening moment C=F×d, where F is the force exerted by the prestressed spring 34 upon the roller 28 in contact with the cam 27.

The means for the displacement of the beam 7 towards its overhanging position in relation to the road vehicle 1 are the same as those described in French patent No 2,683,837 and have therefore need not be described.

Likewise, the means for displacing a bridging span or assembled bridging spans in relation to the beam 7 as well as the means with a plate P carrying in a guided manner the beam 7 and permitting its tilting in relation to the vehicle to permit the depositing of one bridging span or of the assembled bridging spans may be identical with those described in French patent No 2,683,837.

Figure 13:
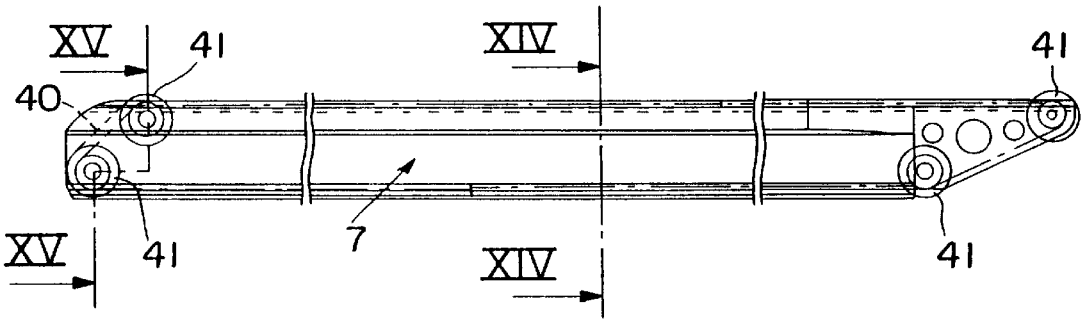
FIG. 13 is a side view of the beam for laying down and launching one bridging span shown in particular in FIG. 11.
Figure 14:
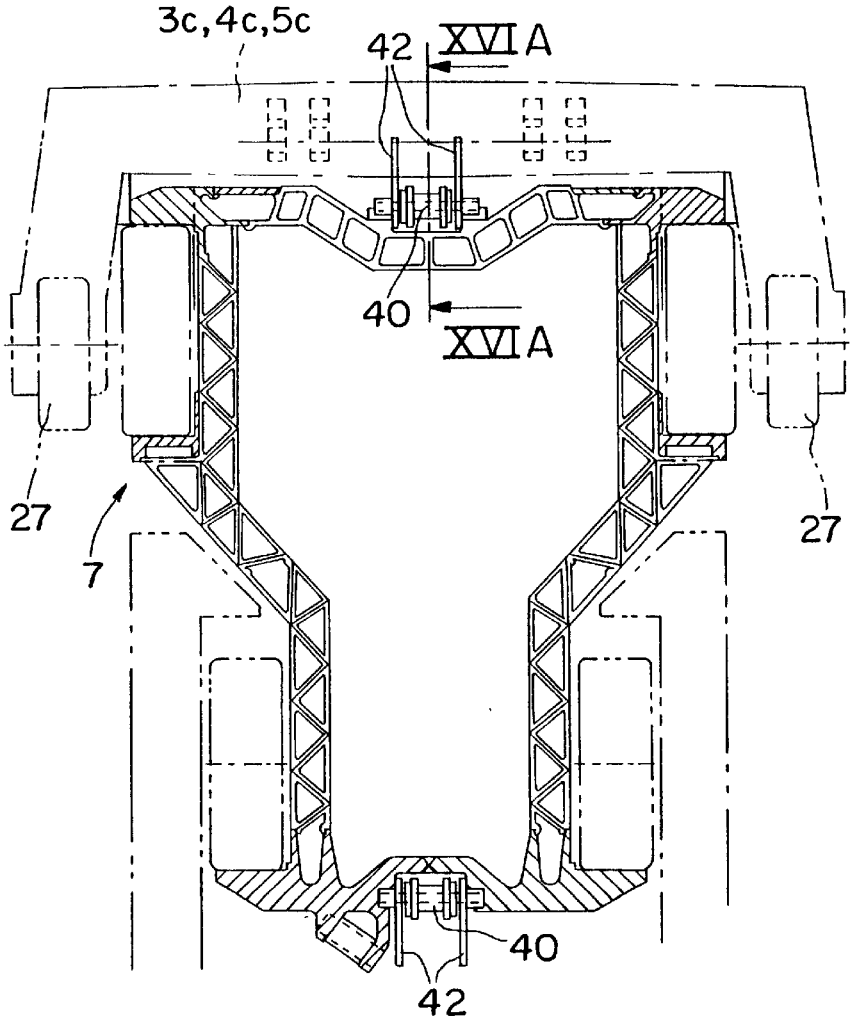
FIG. 14 is a view in section taken along line XIV—XIV of FIG. 13.
Figure 15:
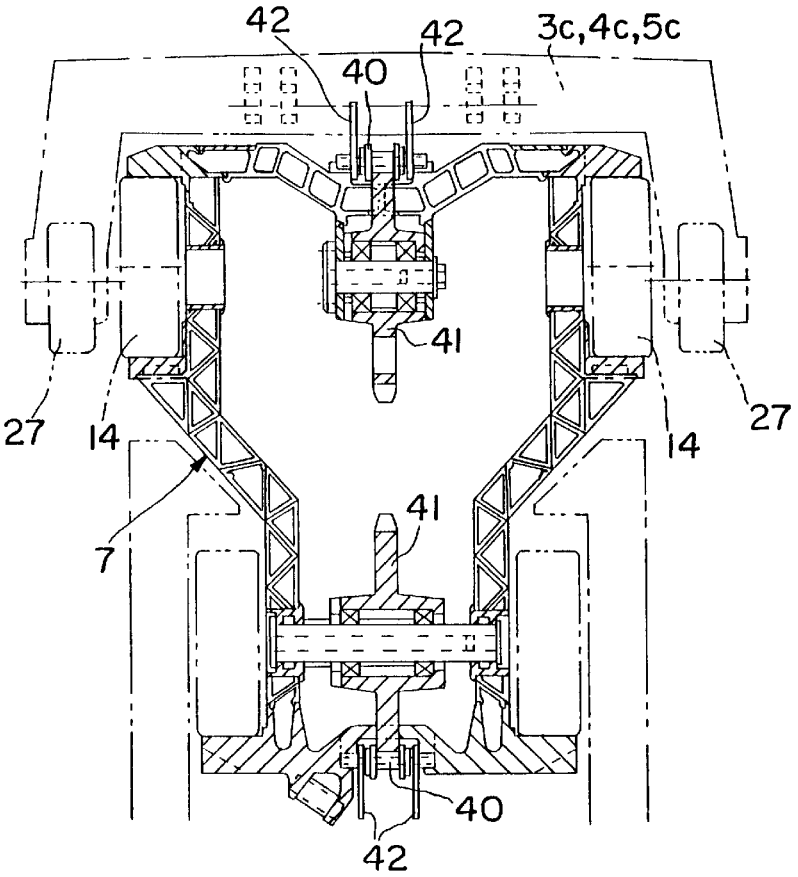
FIG. 15 is a view in section taken along line XV–XV of FIG. 13.
Figure 16A:
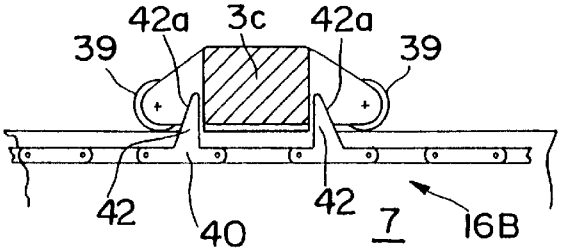
FIG. 16A is a partial view in section taken along line XVIA—XVIA of FIG. 14
Figure 16B:
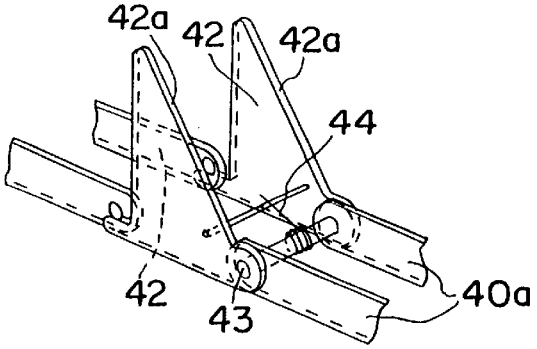
FIG. 16B is a perspective view in the direction of arrow 16B of FIG. 16A.

However, FIGS. 13 to 15 show a particular embodiment of the means permitting the displacement in translation of a bridging span or of assembled bridging spans upon the beam 7.

These means comprise an endless drive chain 40 extending along the longitudinal axis of the beam 7 while passing over toothed wheels 41 in the manner shown in FIG. 13, rotatably mounted onto the structure of the beam 7. The chain 40 is directly driven in a suitable fashion by an electric motor (not shown) mounted onto the tilting plate P. The means for displacing one bridging span in relation to the beam 7 also comprise at least two elements forming a fork 42 made fast to the upper side of the drive chain 40 and adapted to grip the central portion of one of the two connecting arms of one bridging span in particular the rear connecting arm during the phase of launching the bridging span. Preferably both pairs of elements forming a fork 42 are provided to be disposed symmetrically to the middle transverse plane of the beam 7 while being located between both pairs of riding rollers 39 of the same connecting arm. FIG. 14 shows two pairs of elements forming a fork which may also be made fast to the lower side of the chain 40 so as to carry along two or more assembled bridging spans. As shown in FIG. 17, both elements forming a fork 42 located on a same side in the transverse direction of the chain 40 are rotatably mounted at both external ends, respectively, of a pin 43 for the connection of parallel links 40*a* of the chain 40 and are urged back to a position projecting above the upper side of the chain 40 by a spiral spring 44 mounted onto the pin 43 in the middle thereof. Each fork-forming element 42 comprises an inclined portion 42*a* permitting it to be swung downwards by a central portion of a connecting arm of bridge span during the displacement in the suitable direction of the chain 40 for gripping this central portion in order to carry out the phases for launching and depositing the bridging span or the assembling of the latter to another bridging span.

The principle of depositing a bridging span or two or three endwise assembled bridging spans is in a general manner identical with that described in French patent No 2,683,837 but some phases for the launching and depositing of a bridging span or of assembled bridging spans have been shown in FIGS. 17A to 17F to point out some unique features of the present invention.

FIGS. 17A to 17F show the depositing of three endwise assembled bridging spans 3, 4, 5.

Figure 17A:
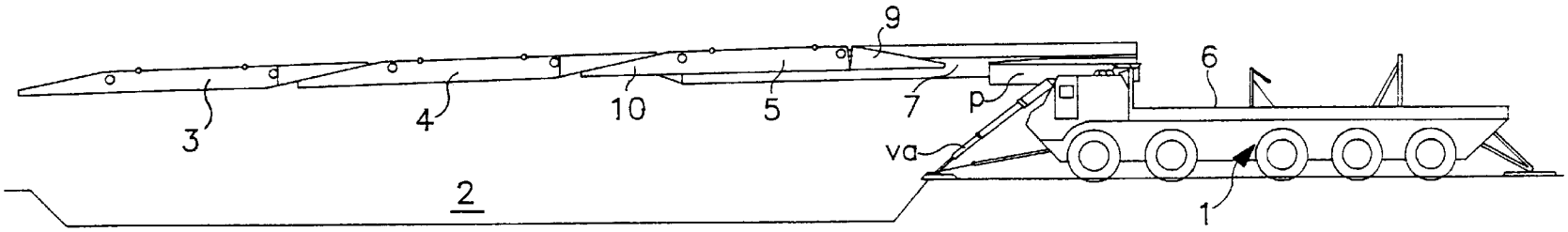
FIGS. 17A to 17F show some of the different phases for depositing assembled bridging spans above a ditch to be crossed.

According to the configuration shown in FIG. 17A, the beam 7 assumes its overhanging position on the tilting plate P in relation to the vehicle 1. In this configuration, the bridging span of great length constituted by the bridging spans 3, 4, 5 is bearing upon the launching beam 7 through the medium of the rollers 39 of the connecting arms 5*c* of the bridging span 5 so that the latter retains its geometry such as that shown in FIG. 1. This geometry is made possible by the fact that the prestressing force exerted by the springs 34 associated with the cams 27, respectively, of the connecting arms is clearly greater than the reaction force exerted upon the connecting arm.

Figure 17B:
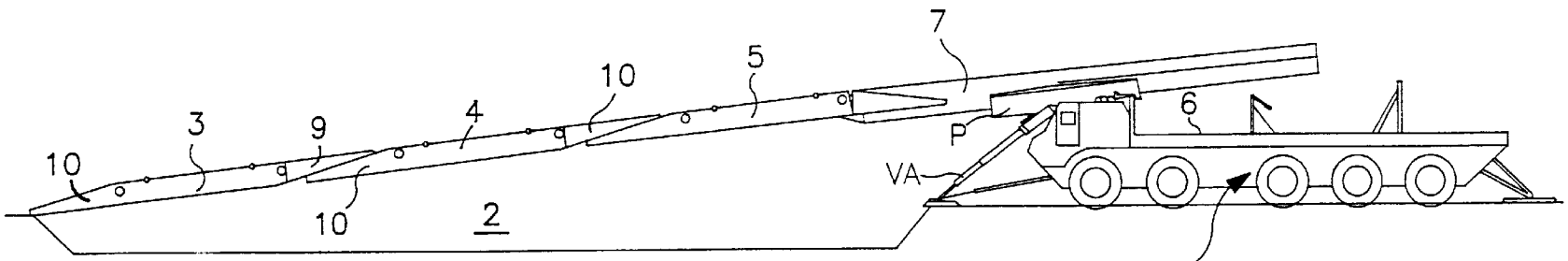

FIG. 17B shows that the plate P has been tilted so as to lay down the end of the bridging span of great length upon the bank opposite to the vehicle 1 and that the beam 7 has been moved backwards in relation to the vehicle 1 until the three bridging spans are held upon the beam 7 by the rear connecting arm of the rear bridging span 5.

Figure 17C:
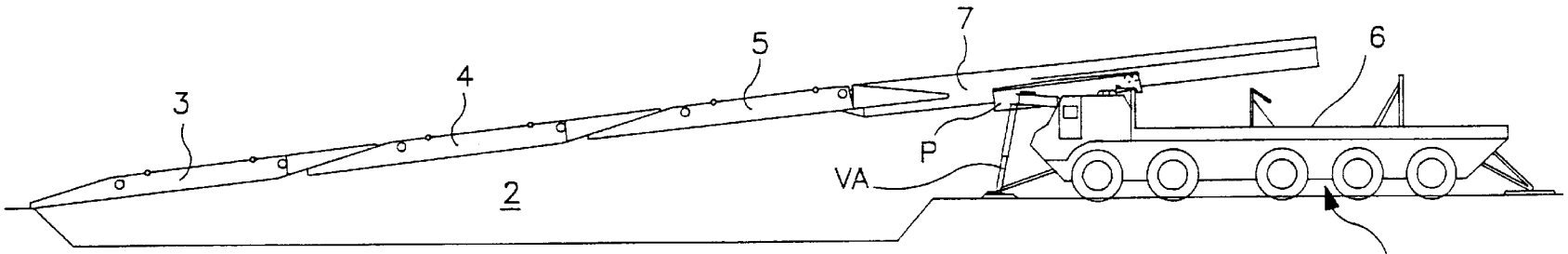
Figure 17D:
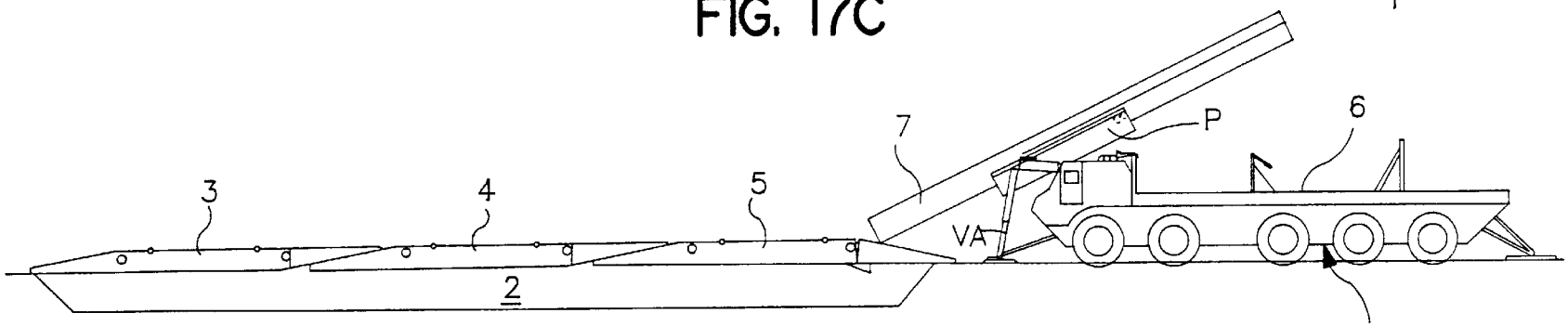

After the withdrawal of the stabilizing forward jack VA from its inclined position shown in FIGS. 17A and B to its approximately vertical position shown in FIG. 17C, the beam 7 is tilted by the tilting plate P until the end of the bridging span of great length is laid down upon the bank of the ditch 2 adjacent to the vehicle 1 as shown in FIG. 17D. During the tilting of the beam 7, the rear connecting arm 5*c* of the bridging span 5 turns about both axes OX so that the connecting arm adapts itself to the different inclinations of the beam 7 and ensures the taking up of the bridging span of great length onto the beam 7.

Figure 17E:
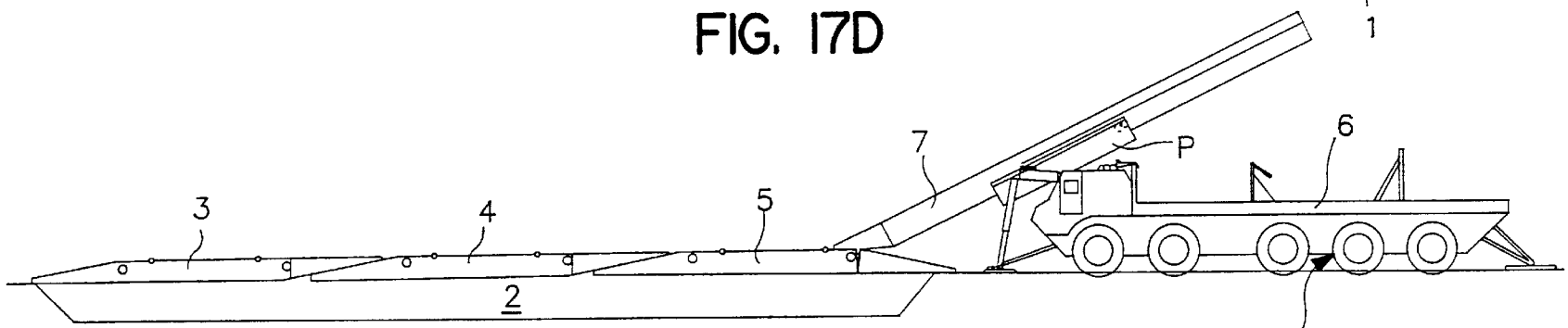
Figure 17F:
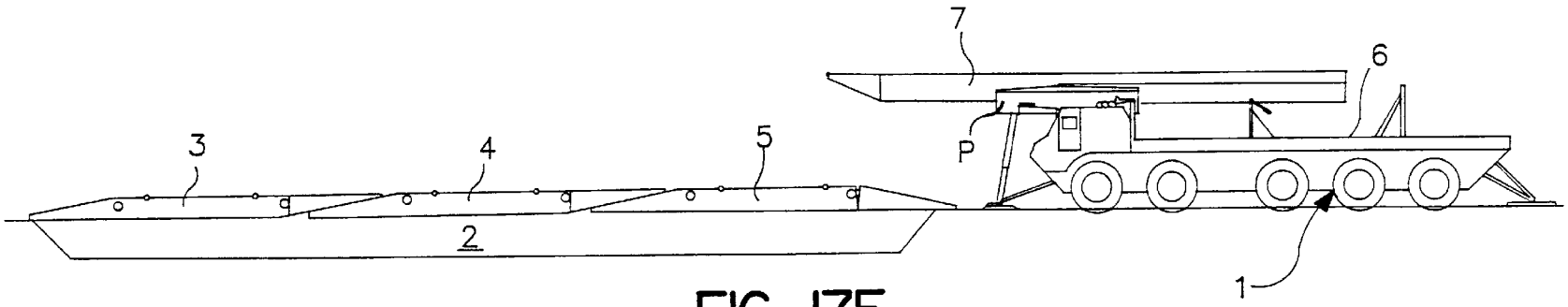

FIG. 17E shows the end or nose of the beam 7 disengaged from the rear connecting arm of the bridging span 5 by the backward motion of the beam 7 on the plate P, whereas FIG. 17F shows that the beam 7 in a position righted by the rotation of the tilting plate P.

Figure 18:
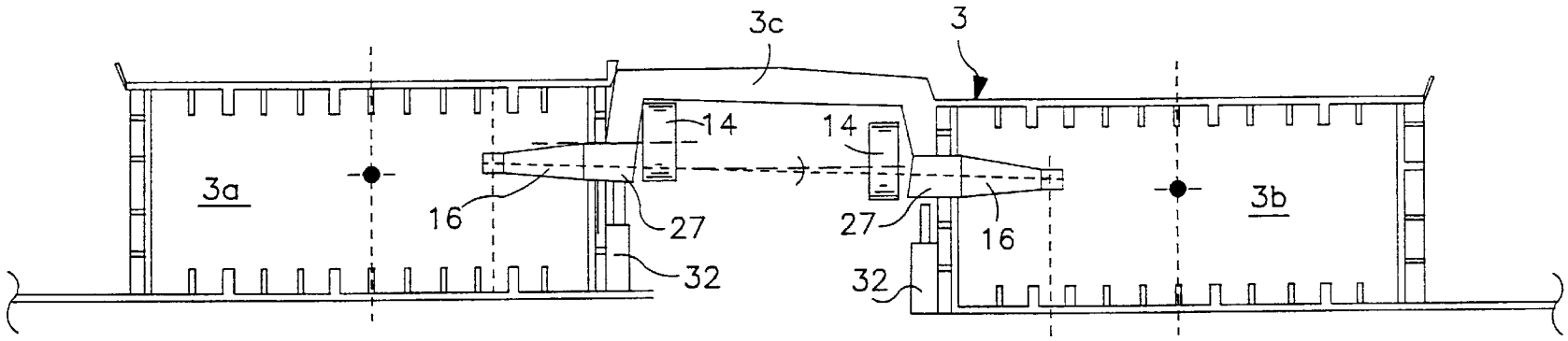
FIG. 18 shows in cross section the configuration of two bridging span elements bearing upon one bank of a ditch, the bank having different levels.

FIG. 18 shows the situation in which one of the banks whereupon is resting the corresponding end portion of one bridging span, such as the bridging span 3, exhibits an inequality of height or step when viewed in cross section. In this case, each connecting arm 3*c* should allow the bridging span to adapt itself to this bank configuration or any other configuration such as that where the bank consists of two portions inclined towards each other. Thus in working condition, the substantial weight of the vehicles moving over the bridging span permits the compression of the prestressed springs 34 associated with the cams 27, respectively, and the whole may deform itself as shown in FIG. 18 by displacement along both axes OZ of the connecting arm 3*c* and therefore adapt itself to the different bank configurations. This function permits the optimization of the weight of the connecting arms which are dimensioned by the weight of the bridge being launched and the braking effects of the vehicles and not by the forces exerted during the passage of the vehicles.

Figure 7:
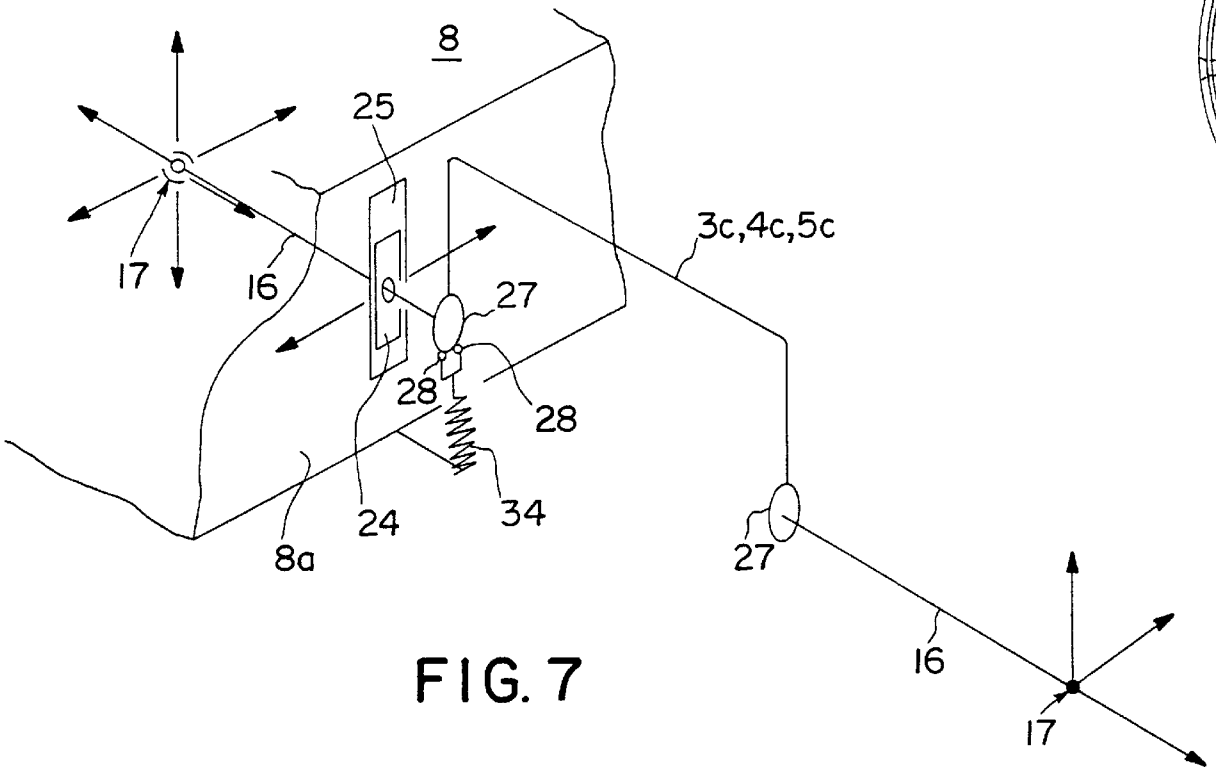
FIG. 7 is a perspective view diagrammatically showing the assembly of one connecting arm between two bridging span elements.

Of course the connecting arms of the bridging spans should keep both bridging span elements parallel and prevent them from offsetting themselves with respect to each other whatever the external actions exerted upon them such as the passages of vehicles, the braking of vehicles, the banking, etc. might be. For that purpose the forces are taken up by the ball-and-socket pivotal connections 17 and the bearings 24 as shown by the different arrows shown in FIG. 7.

The bridging span structure of the invention described hereinabove therefore allows each one of its connecting arms to be retracted into the configuration of transportation of superposed bridging spans, to sustain the moment due to the own weight of the bridging spans during the launching phase; to transmit the translation forces of each bridging span in relation to the launching and depositing beam; to bear the weight of the bridging span during depositing; to adapt itself to the relative angle during the depositing between the bridging span and the launching beam; to adapt itself to the different conditions of the bank and to connect both bridging span elements in parallel relationship with respect to each other.

What is claimed is:

1. A bridging span structure intended for the crossing of ditches by vehicles, comprising two parallel bridging span elements with upper treadways and connected to each other by two connecting arms forming braces, wherein each connecting arm has approximately the shape of an Ω both coaxial base elements of which comprise bolts having each one of their ends connected to the body of the corresponding bridging span element by a ball-and-socket pivotal connection, each pivoted bolt is rotatably mounted oppositely from its ball-and-socket pivotal connection in a bearing held against rotation at the body of the bridging span element and slidable in relation to the latter so as to permit the displacement of the pivoted bolt in a plane perpendicular to the bridging span elements about the center of pivotal connection of this bolt, and means are provided for automatically urging each connecting arm back to its normal position of use in a plane substantially perpendicular to both bridging span elements and to hold the connecting arm in this normal position of use.

2. A bridging span structure according to claim 1, wherein the means for returning and holding each connecting arm comprise two parallel identical cams made fast to the connecting arm at both ends, respectively, of the pivoted bolts opposite to the ball-and-socket pivotal connections and the axes of rotation of which are coaxial with the axes of rotation of the pivoted bolts, and two rollers held in bearing relationship by an elastic means upon the lower portion of the eccentrically shaped formation of each cam with a force ensuring the holding of the connecting arm in its normal position of use, the eccentrically shaped formation of the cam being such that during a rotation of the connecting arm in one direction or in the other one, either one of both rollers exerts upon this cam a torque for rightening the connecting arm back to its normal position.

3. A bridging span structure according to claim 2, wherein both rollers are mounted onto a common yoke made fast to one end of a supporting shaft slidably mounted in a stationary casing made fast to the body of the corresponding bridging span element and wherein the elastic means comprises a prestressed spring accommodated in the stationary casing and exerting upon the supporting shaft a force for holding both rollers or either one thereof in bearing relationship upon the periphery of the corresponding cam.

4. A bridging span structure according to claim 3, wherein each prestressed spring has its maximum length in the normal position of one associated connecting arm.

5. A bridging span structure according to claim 2, wherein the lower portion of each cam whereupon both corresponding rollers are simultaneously bearing thereon, is flat and is located between two symmetrical portions of the eccentrically shaped formation of the cam.

6. A bridging span structure according to claim 1, wherein the bearing is a parallelepipedic block accommodated in a rectangular guiding window of the block formed in the body of the corresponding bridging span element in perpendicular relation to the longitudinal axis of the latter.

7. A bridging span structure according to claim 6, comprising protective rubber bellows tightly closing the passageways between the bearings and the rectangular guiding windows.

8. A bridging span structure according to claim 1, wherein each ball-and-socket pivotal connection comprises a bracket for supporting a female sphere in which is accommodated a male sphere made fast to the end of the corresponding pivoted bolt, the supporting bracket being itself fastened in a supporting part made fast for example by welding to the body of the corresponding bridging span element.

9. A bridging span structure according to claim 1, comprising at least two stops each associated with one of the connecting arms and made fast to one of the bridging span elements and upon which the corresponding connecting arm may be caused to bear in a downward swung position of the latter.

10. A bridging span structure according to claim 1, wherein each connecting arm comprises two pairs of riding rollers mounted on a central connecting portion of the connecting arm and extending parallel to the bridging span elements.

11. A system for transferring upon a vehicle at least two bridging spans which are superposed on a chassis of the vehicle and which may be assembled end-to-end and for depositing each one of the bridging spans or endwise assembled bridging spans over a ditch to be crossed, comprising in combination at least two bridging spans according to claim 1, a beam for supporting and launching each bridging span or assembled bridging spans and displaceable in relation to the vehicle to an overhanging position, means for displacing each bridging span or assembled bridging spans in relation to the beam to an overhanging position forward of the beam, and a plate supporting in a guided fashion the beam and tiltable in relation to the vehicle together with the beam to permit the depositing of each bridging span or assembled bridging spans, wherein during the depositing of each bridging span or assembled bridging spans, that end of the bridging span or assembled bridging spans which is opposite to that already bearing upon a bank of the ditch opposite to the vehicle, is supported at the end of the beam by a rear connecting arm of both bridging span elements of each bridging span or of a rear bridging span of the assembled bridging spans during the tilting of the beam until the depositing of the end of the bridging span or of the assembled bridging spans upon a bank of the ditch adjacent to the vehicle, and the connecting arm bearing upon the beam may pivot in relation to the bridging span elements about the pivoted bolts so that the connecting arm may adapt itself to the different inclinations of the beam.

12. A system according to claim 11, wherein in the transportation position upon the vehicle, the beam is disposed between two superposed bridging spans and the connecting arms of both bridging span elements of a lower one of the superposed bridging spans assume a downward swung position underneath the beam while being in contact with the latter through riding rollers of the connecting arms.

13. A system according to claim 12, wherein each bridging span includes at least two stops each associated with one of the connecting arms and made fast to one of the bridging span elements and upon which the corresponding connecting arm may be caused to bear in a downward swung position of the latter, and both downwards swung connecting arms of the lower one of the superposed bridging spans are also bearing upon the stops made fast to the bridging span elements.

14. A system according to claim 12, wherein the connecting arms are rightened up to their normal position by the returning means exerting the rightening torque thereupon after withdrawal of the beam from between both superposed bridging spans.

15. A system according to claim 11, wherein the means for displacing the bridging span or the assembled bridging spans in relation to the beam comprise an endless drive chain extending along the longitudinal axis of the beam and mounted over at least two toothed end wheels rotatably mounted onto the beam, and at least two elements forming a fork, made fast to the drive chain and adapted to grip the central portion of one connecting arm between both pairs of riding rollers of this arm bearing upon the beam.

16. A bridging span structure according to claim 1, wherein the bridging span structure is capable of being crossed by armored vehicles.

* * * * *